United States Patent [19]

Alexander

[11] Patent Number: 4,644,965

[45] Date of Patent: Feb. 24, 1987

[54] PERMANENT WAVE HAIR ROD

[76] Inventor: Larry R. Alexander, 101 Florence Ave., Evanston, Ill. 60202

[21] Appl. No.: 788,889

[22] Filed: Oct. 18, 1985

[51] Int. Cl.[4] ..... A45D 2/00

[52] U.S. Cl. ..... 132/40; 132/33 R; 132/31 R

[58] Field of Search ..... 132/33 R, 31 R, 40, 132/38 R, 39, 43; D28/37

[56] References Cited

U.S. PATENT DOCUMENTS

| | | | |
|---|---|---|---|
| 3,433,233 | 3/1969 | Thackeray | 132/40 |
| 3,675,663 | 7/1972 | Calandra | 132/40 |
| 3,910,290 | 10/1975 | Zitman | 132/39 |
| 4,216,787 | 8/1980 | Moca | 132/39 |
| 4,316,476 | 2/1982 | Merges | 132/40 |
| 4,317,461 | 3/1982 | Anderson | 132/40 |
| 4,513,760 | 4/1985 | Tihonovich | 132/40 |
| 4,546,781 | 10/1985 | Schmitz | 132/31 R |

FOREIGN PATENT DOCUMENTS

| | | | |
|---|---|---|---|
| 60170 | 9/1982 | European Pat. Off. | 132/31 R |

*Primary Examiner*—Gene Mancene
*Assistant Examiner*—John G. Weiss
*Attorney, Agent, or Firm*—Bernard L. Kleinke

[57] ABSTRACT

A device suitable for use as a permanent wave rod and hair styling roller is disclosed that employs a tubular component as a permanent wave rod, the tubular component having a first end portion, a second end portion, and a mid-portion therebetween about which to wind a lock of hair in the process of hairdressing. The device includes a first annular flange attached to the first end portion and a second annular flange attached to the second end portion, each flange having a periphery with a plurality of facets. A connector arrangement is included for enabling connection of each one of the end portions to a corresponding end portion of a similar device so that a facet on each one of the annular flanges bears against a facet on the similar device to inhibit rotation and unwinding of hair, without producing kinks in the hair.

16 Claims, 10 Drawing Figures

PERMANENT WAVE HAIR ROD

TECHNICAL FIELD

This invention relates in general to permanent wave hair rods, and more particularly to a device suitable for use as a permanent wave rod to facilitate creative hair styles.

BACKGROUND ART

Nowhere is the right implement for the job more important than in waving and styling hair. There have been many different types of implements designed to satisfy this need.

Hair rods and hair rollers are typical examples. They share the common function of providing a form around which hair is wound and secured, while the hair chemically processes during the process of giving a permanent wave or styling hair. However, they share some common problems also.

After a thorough washing and any desired treatment, the hair is wound, lock by lock, on individual hair rods or rollers, retained in place by suitable means, such as a rubber band clamped over the hair, and left to process chemically or dry. However, the clips and rubber bands almost invariably press against the hair, and thereby produce an unwanted kink or crease in the hair as it dries.

Since it is difficult, if not impossible to remove these kinks without removing the desired curl, it is desirable to have a new and improved device that would alleviate the unwanted kink problem. In this regard, such a device should stay in place with the lock of hair securely wound about it, without unwinding therefrom or causing the hair to be creased or kinked.

Another problem associated with existing hair rods relates to the desire for arranging them adjacent to one another in a particular pattern to achieve a desired hair style, after the hair has dried and been combed out. Existing hair rods simply lie flat against the head, supported by the lock of hair wound around it. No adequate way is provided for arranging the hair rods or rollers in a desired pattern in relation to one another, to achieve a desired creative affect. Consequently, it is desirable to have a new and improved hair rod that would better enable controlled placement of the device on the head.

In addition, it is desirable to have a lightweight, durable, inexpensive to manufacture device suited to the standards of professional hairdressers, as well as for convenient use at home.

DISCLOSURE OF INVENTION

Therefore, the principal object of the present invention is to provide a new and improved permanent wave hair rod or the like, which enables more creative and unusual hair styles to be created.

It is another object of the invention to provide such a device, which can be used conveniently without producing creased or kinky hair, and which facilitates placement in a desired pattern on the head.

Briefly, the above and further objects of the present invention are realized by providing a hair rod, which can be arranged with like or similar rods, on the head to help create a desired hair style.

A permanent wave hair rod according to the invention includes a tubular component having a first end portion, a second end portion, and a mid-portion therebetween about which is to wind a lock of hair in the process of hairdressing. A first annular flange is attached to the first end portion of the rod, and a second annular flange is attached to the second end portion. Each annular flange includes a periphery having a plurality of generally flat surfaces, or facets, thereabout, and these may take the form of flanges that are polygonally-shaped in cross section.

Connectors are provided for enabling connection of each one of the end portions to a corresponding end portion of a similar adjacent rod during the process of hairdressing, so that a facet on each one of the annular flanges bears against or engages a facet on the adjacent rod to inhibit unwanted, inadvertant axial rotation of the rods and accompanying unwinding of the hair. Thus, the rods stay clamped together in place on the head, without kinking the hair.

In one form of the invention, connection is achieved using a first axle portion attached to the first end portion of the rod, a second axle portion attached to the second end portion of the rod, and connectors in the form of axle connectors for enabling connection of the corresponding axle portions of similar adjacent rods. In one form of the invention, the axle connectors comprise an elastic band suitably shaped and dimensioned to interconnect the corresponding axle portions.

Another form of the invention includes an opening in each axle portion and an elongated member in the form of a mating connector stick that can be forced through the opening in the axle portion and into the opening in an adjacent axle portion of another rod, to interconnect and to retain the rods relative to one another as desired.

By use of the connectors, a row of the rods can be positioned at a desired angle to the head, for causing the hair to be set in a desired configuration to create an unusual or creative hair style.

BRIEF DESCRIPTION OF DRAWINGS

The above-mentioned and other objects and features of this invention, and the manner of attaining them, will become apparent, and the invention itself will be best understood, by reference to the following description of embodiments of the invention taken in conjunction with the accompanying drawings, wherein.

DETAILED DESCRIPTION

Figures 1, 2, 3, 4:
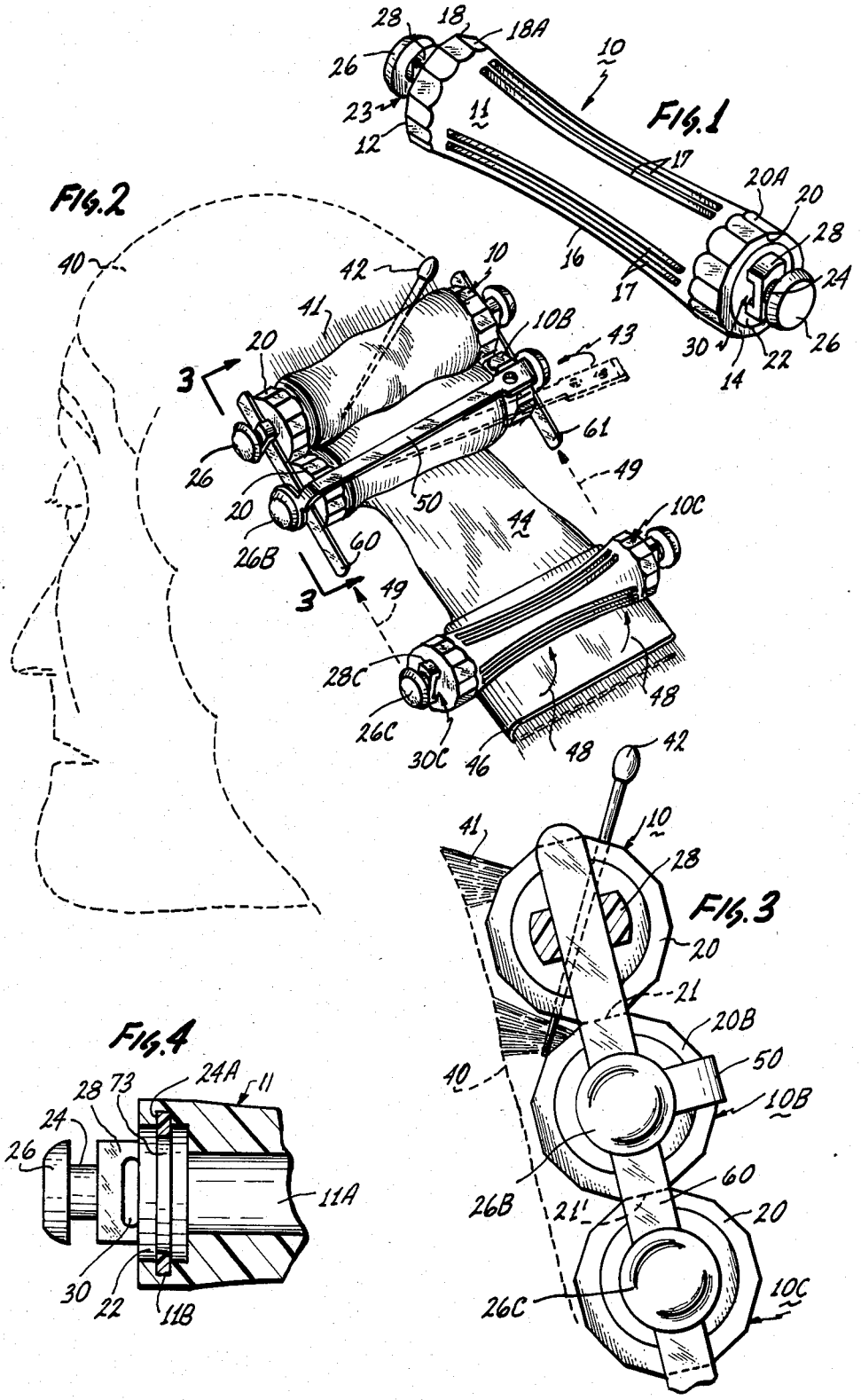
FIG. 1 of the drawings is a perspective view of a permanent wave hair rod constructed according to the invention.
FIG. 2 is a pictorial reduced-scale view showing three such hair rods in place on a human head and in the process of having a lock of hair wound thereabout.
FIG. 3 is an enlarged side elevational, partially sectional view of the hair rods of FIG. 2 taken substantially on line 3—3 of FIG. 2.
FIG. 4 is an enlarged fragmentary, partically sectional view of an end portion of the hair rod of FIG. 1.
Figure 5:
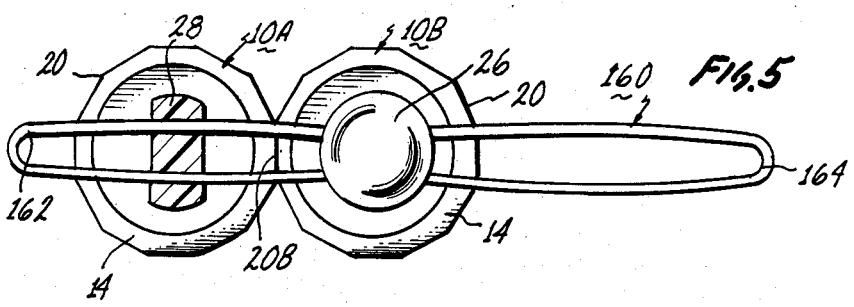
FIG. 5 is a side elevational, partially sectional view of two of the hair rods of FIG. 2 interconnected by a connector stick.

Referring now to the drawings, and more particularly to FIG. 1 thereof, there is shown a permanent wave hair rod 10, which is constructed according to the invention.

The hair rod 10 generally comprises a tubular component 11 having a first end portion 12, a second end portion 14, and a mid-portion 16 extending therebetween. The illustrated hair rod 10 employs a tubular component with enlarged ends and a gradually-tapered mid-portion. This tubular component 11 is hollow throughout its axial length, and includes a plurality of slits 17 to provide access to the interior. The slits permit saturation and drainage of permanent wave solution, as well as air flow, and thus promote chemical processing and drying of hair wound around the mid-portion 16.

The rod 10 includes a first annular flange 18 attached to the the first end portion 12, and a second annular flange 20 attached to the second end portion 14. Each of these annular flanges is integrally connected to opposite ends of the mid-portion 16 in the illustrated form of the invention, and each has a periphery with a series of generally flat surfaces or facets, facets 18A and 20A of the respective end portions 12 and 14. Each of the flanges in a preferred form of the invention has 12-sided, polygonally-shaped cross sections, although other cross sectional shapes may be employed within the inventive concepts herein disclosed..

The plurality of facets about the periphery of the annular flanges, are used during the process of hair dressing to keep the rods from rotating, and thus the hair from unwinding therefrom. Also, the twelve facets enable the rod to engage securely an adjacent like or similar rod at twelve different angles. As best shown in Fig.2, this is accomplished by interconnecting the ends of adjacent similar rods so that the facets bear against or abut each other. Thus, by connecting the ends of the rods together, the locks of hair wrapped thereabout are disposed therebetween, and the hair does not come loose, without being creased by a rubber band or other device.

Figure 6:
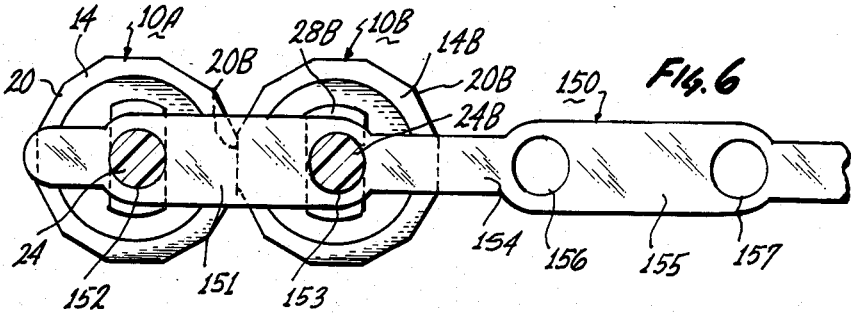
FIG. 6 is a view, similar to the view of FIG. 5, showing two of the hair rods of FIG. 2, interconnected by a rubber band connector.

Each device has a pair of axle assemblies 22 and 23 at opposite ends thereof. Since both assemblies are similar to one another, one assembly 22 will now be described. The assembly 22 includes axle portion 24 and cap portion 26. As shown in FIG. 4, these axle assemblies enable interconnection of a row of rods so that the facets bear against each other to prevent axial rotation of the rods. The axle assemblies at both ends of the rods may be interconnected with a connector, such as the sticks 60 and 61, or the elastic band 150 (FIG. 6) alternatively. They include an enlarged portion 28 defining an opening 30 for use in interconnecting two or more of the rods with a connector stick 60 which slides frictionally through a series of aligned openings. When the band or strip 150 is employed, the cap portion slips through openings, such as the opening 152 (FIG. 6). It should be understood that either the stick or the band may be employed as the connector, but both need not be employed at the same time, as illustrated. Also, the conventional pin or pick 42 may be used as another alternative connector. A conventional elastic band 50 may also be employed in a conventional manner, if desired, extending lengthwise across the rod to hold down the hair, and thus to serve as an alternative connector.

Further details of the rod are shown in FIG. 2–4. Thus, in FIG. 2, human head 40 is illustrated with a lock of hair designated 41 that is wound around the mid-portion of rod 10A according to this invention. The pin or pick 42 inserted through slits 17 may be used to hold the rod in place. A lock of hair is wound around like rod 10B in a similar manner so that rod lOB lies along side rod 10, with adjacent flat surfaces abutting 21.

Another like rod 10C, is illustrated in the initial position it occupies as lock of hair 44 is wound around it. A slip or sheet 46 of absorbent paper is typically wrapped around the lock of hair, and the wrapped lock is then wound about the rod by rotating the lock of hair and rod in the direction indicated by arrows 48, while rod 10C advances in the direction of arrows 49 to lie adjacent device 10B in the position illustrated in FIG. 3.

Elastic band 50 may be employed to secure rod 10B by slipping it over both axle assemblies in the direction of arrow 43 (FIG. 2) as an alternative means of connection. Also, connector stick 60 may be employed alternately to interconnect the three illustrated rods, or additional ones (not shown), by slipping the connector stick through the aligned openings, such as the opening 30 and the opening 30C, in adjacent axle assemblies to be held frictionally in place. A like stick 61 interconnects the opposite ends of the rods in a similar manner.

As shown in FIG. 4, tubular component 11 has a hollow interior 11A that includes an internal annular groove 11B. The axle assemblies are separate components in this embodiment of the invention, and they include an annular clip or split locking ring 23 that mates with the annular groove, and fits within an annular groove 73 of the member 26 to enable it to rotate about the axis of the rod. Thus, the member 26 can be rotated to align the hole 30 with the corresponding holes in similar rods, so that the stick can be slipped therethrough. The axle assembly to be snapped into place at the end of the tubular component. However, a rod employing the axle assemblies and tubular component of a one-piece unitary construction is also within the inventive concepts herein disclosed and claimed.

As shown in FIG. 3, the three rods are positioned to lie closely together in a row at side-by-side positions in a common plane so that the corresponding annular flange portions bear against one another at 21 and 21'. Surface 20A of one flange portion bears against adjacent like surface of the adjacent flange portion at these abutments to inhibit rotation of the rods and related unwinding of the hair.

Connector stick 60 is shown broken at one end in FIG. 3 to indicate that the illustrated connector stick may be sufficiently long in length to interconnect four or more similar rods. However, it is to be understood that other various different sized connector sticks may be employed in place of the illustrated sticks.

Turning now to FIGS. 5–8, there are shown alternate forms of various aspects of the invention, where reference numerals are increased by increments of 100 over those designating similar components in FIGS. 1–4. Connector stick 160 in FIG. 5 comprises an elongated loop or open frame of a deformable resilient material extending from end 162 to end 164. It may be composed of a plastic composition, and it resiliently deforms slightly traversely to enable it to be forced through an opening 30 and held frictionally in place.

Elastic band 150 in FIG. 6 illustrates another technique for interconnecting the axle portions. It is a resilient strip preferrably composed of rubber with a pair of holes 152 and 153 in first wide portion 151 which is interconnected by narrow portion 154 to a second wide portion 155, through which extends a second pair of holes 156 and 157. Hole 152 is placed over cap 24 of rod lOA and hole 153 is placed over cap 24B on rod lOB to interconnect the two rods so that their flange portions bear tightly against one another. Holes 156 and 157 may be similarly placed over caps (not shown) on the axle assemblies of other similar rods, or on the other axle assemblies of the same rods. Narrow portion 154 enables the elastic bank to be stretched more easily for this purpose.

Figure 7:
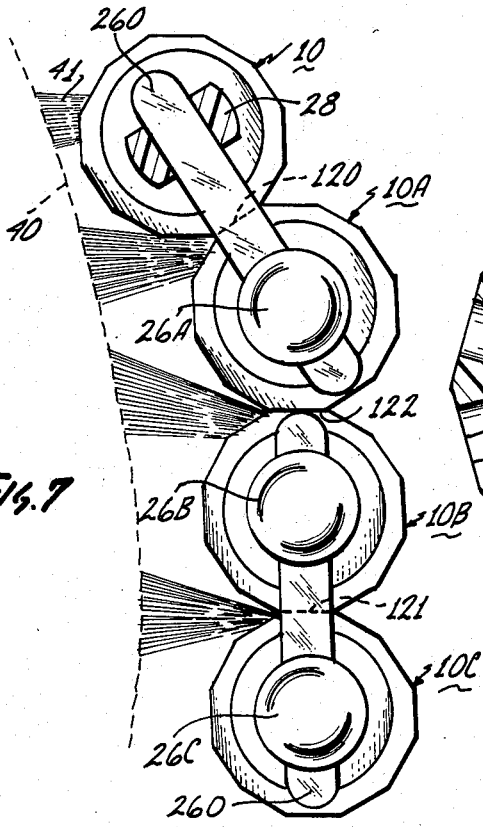
FIG. 7 is an elevational, partially sectional view of four of the hair rods, each one being similar to the rod of FIG. 1, and being arranged in a desired pattern on a human head.

Referring to FIG. 7, there is shown a series of like hair rods 10A, 10B and 10C, which are identical to rod 10. Rod lOA is shown connected to rod 10 by short stick 260 to cause them to engage one another at 120. Similarly, rods IOB and 10C are interconnected by stick 260 and engage at 121. The rods lOA and 10B engage at 122.

By this technique, the rods are positioned to follow the contour of the head.

Figure 8:
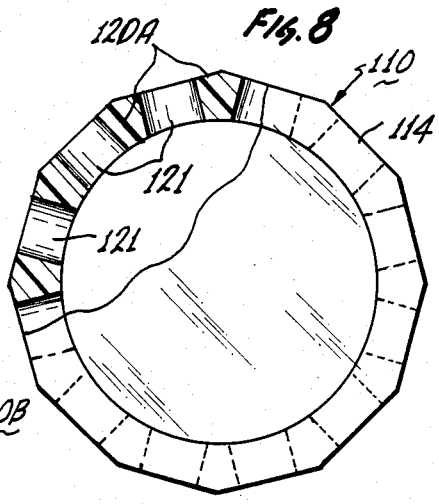
FIG. 8 is a greatly enlarged end view of a direction changing hair rod constructed according to the present invention, and showing appurtures in the annular end flange.
Figure 9:
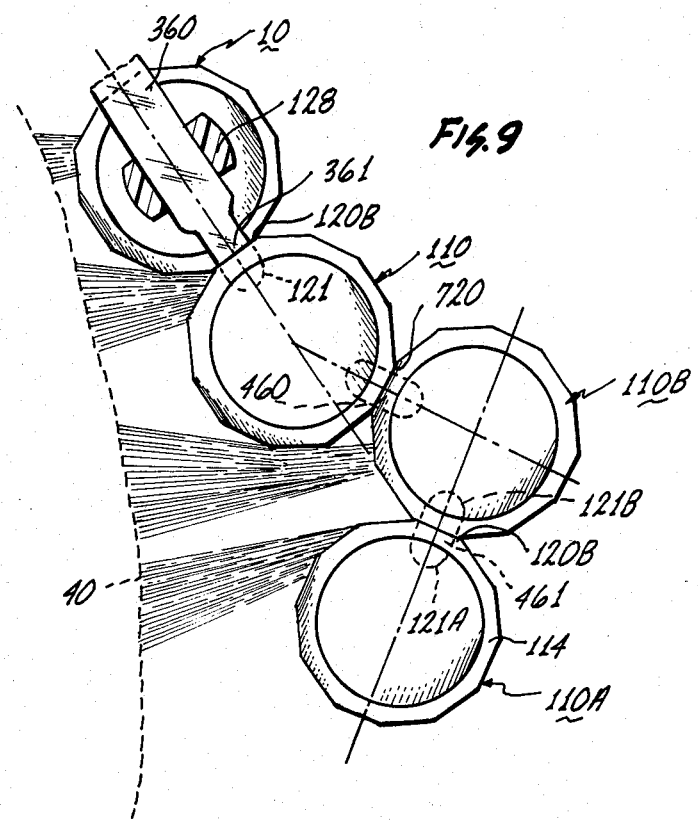
FIG. 9 is a view similar to FIG. 7, showing four hair rods of FIG. 8, arranged in a desired pattern using the appurtures in the annular flange.

FIGS. 8 and 9 illustrate another form of rod 110, interconnected with like rods 110A, interconnected by short connector sticks 460 and 461 in a desired pattern. The rod 10 is connected to rod 110 by stick 360. The rods 110, 110A and 110B are slightly longer than rod 10 to enable placement of connector stick 360 through the axle assembly of rod 10 and into a hole 121 of rod 110.

FIG. 8 shows a transverse cross section of the longer rod 110 to illustrate the placement of holes 121 (or apertures) in each facet around the periphery of the enlarged end (or annular flange). Using these holes 121, rod 110B is connected to rod 110A to achieve an artistic non-linear design illustrated in FIG. 9. In this regard, the rods are spaced by various different distances from the bead to achieve a desired effect.

The interconnection of rod 10 and rod 110 is further illustrated in FIG. 9. Thus, rod 10 and longer rod 110 are interconnected with a connector stick 360, which has a reduced width end portion 361 that fits into the hole 121 in rod 110. Rod 10 and rod 110 are thereby interconnected in a first plane passing through the longitudinal exis of each. Rod 110B and 11OA are interconnected in a second plane, with even shorter connector stick, in the form of peg 461, inserted in holes 121B and 121A of respective rods llOB and 110A, and rod 110 and rod 110B are also interconnected by peg 460 with a desired angle between these two planes at 720. A creative hair styling pattern is achieved in this manner.

Figure 10:
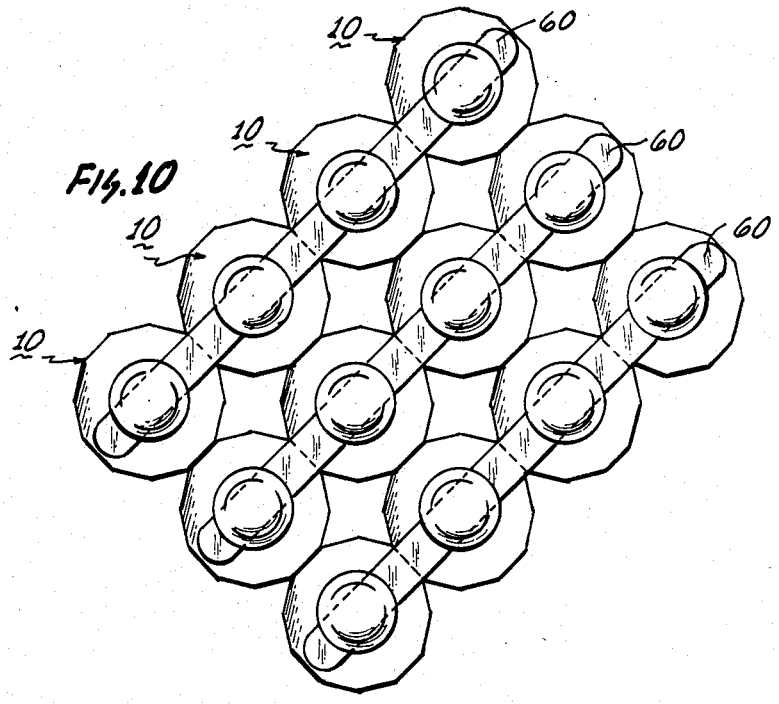
FIG. 10 is a side elevational view of a group of hair rods, each one being similar to the hair rod of FIG. 1, and being shown interconnected with interconnecting sticks for storage purposes.

As shown in FIG. 10, the rods of this invention nestle conveniently together for storage. Three rows of four rods each are shown and this avoids the inconvenience and unsightliness associated with the helter skelter storage of existing rods in a conventional permanent wave rod tray (not shown).

The illustrated rods are inexpensively manufactured using suitable heat-resistant material such as "POLYMETHYL PENTENE" and "POLYSULFONE." Such materials enable the hair to be dryed in a hot air hair dryer with the rods in place on the head, when alternatively being used as wet set, styling hair rollers. They are molded using known fabrication techniques, with light weight, multi-colored, attractive, clear-plastic, easy to use and functionally improved rods resulting. Other materials and means of fabrication may be employed.

While various changes may be made in the form, construction, and arrangement of the procedures and parts described herein, without departing from the spirit and scope of the invention and without sacrificing any of its advantages, all matter herein is to be interpreted as illustrative and not in any limiting sense. For example, while the device of the present invention has been shown and described to be in the form of a hair rod, it will become apparent to those skilled in the art that the device of the present invention may also be in the form of a hair curler, as well.

What is claimed is:

1. A device for use in hairdressing comprising:

a tubular component having a first end portion, a second end portion, and a mid-portion therebetween about which to wind a lock of hair in the process of hairdressing;

a first enlarged portion at the first end portion and a second enlarged portion at the second end portion, each enlarged portion having a periphery formed of a plurality of a small number of facets and being polygonal in cross section, each one of said facets having a substantial flat surface area contiguous to like facets on either side thereof to define a discrete radial angle for engaging a like facet of a similar device and help support said similar device at a desired distance away from the scalp of a person whose hair is being dressed;

a pair of first and second end members at respective ones of the first and second end portions in positions extending axially outward therefrom; and connection means including first and second projection on each one of the respective first and second end members for enabling each one of the end portions to be connected to a corresponding end portion of a similar tubular component by interconnecting corresponding end members to cause a single selected facet on one device to bear against a single selected facet on a similar tubular component over a substantial surface areas of interengagement to inhibit relative axial rotation, and for enabling a pair of the devices to be positioned relative to one another for arranging the hair in a desired configuration.

2. The device recited in claim 1, further comprising:

stretchable strip means, including a stretchable band having two spaced-apart pairs of holes enabling placement of one of the pairs over the first projection and a corresponding projection of a similar device, and the other one of the pairs over the second projection corresponding portion of the similar device, so that the facets bear against one another.

3. The device recited in claim 1, wherein:

each annular flange defines a plurality of radially-aligned apertures around the periphery of the flange to enable connection of the flange to a similar device by insertion of an elongated member in a selected one of the apertures.

4. The device recited in claim 1, wherein:

the device is composed of a heat-resistant material.

5. The device recited in claim 4, wherein:

the heat-resistant material is polymethyl pentene.

6. The device recited in claim 4, wherein:
the heat-resistant material is polysulfone.

7. A device as recited in claim 1, wherein:
said small number is twelve.

8. A device for use in hairdressing comprising:
a tubular component having a first end portion, a second end portion, and a mid-portion therebetween about which to wind a lock of hair in the process of hairdressing;
a first annular flange attached to the first end portion and a second annular flange attached to the second end portion, each annular flange having a periphery with a plurality of facets; and
connector means for enabling connection of each one of the end portions to a corresponding end portion of a similar deive so that a facet on each one of the annular flanges bears against a facet on the similar device to inhibit rotation;
wherein the connector means includes a first axle portion attached to the first end portion and a second axle portion attached to the second end portion, and axle connector means for enabling connection of each one of the axle portions to a corresponding axle portion of a similar device so that the facets bear against each other; and
wherein the first and second axle portions each define an opening for receiving an elongated member to enable connection of each one of the axle portions to a corresponding axle portion of a similar device by placement of an elongated member through the openings.

9. The device recited in claim 8, further comprising:
a plurality of elongated members, each elongated member having a size and shape enabling insertion into an axle portion for frictional engagement therewith.

10. The device recited in claim 9, wherein:
each one of the elongated members is in the form of a stick that is traversely flexible to provide frictionally engagement when inserted in a hole in the axle portion.

11. The device recited in claim 8, wherein:
each one of the axle portions in rotatably attached to the tubular component to enable alignment of the hole in the axle portion with a hole in an axle portion of a similar device.

12. The device recited in claim 11, wherein:
the tubular component includes a recess at each end thereof, the recess defining an annular groove; and the axle portion includes an enlarged portion that fits into the recess, the enlarged portion having an annular rib that engages the annular groove to provide functional engagement while enabling manual rotation of the axle portion relative to the tubular component.

13. A device for use in hairdressing, comprising:
a tubular component having a first end portion, a second end portion, and a mid-portion therebetween about which to wind a lock of hair in the process of hairdressing;
a pair of integrally attached first and second annular flange portions of the tubular component, each annular flange having a periphery with a plurality of facets; and
aperture means defining a plurality of apertures around the periphery of the flange portions for enabling connection of a flange portion to the flange portion of a similar tubular component by insertion of an elongated member between the two flange portions in selected ones of the apertures.

14. The device recited in claim 13, further comprising:
axle means defining a pair of first and second end members adapted to be manually snapped into respective ones of the end portions in positions extending axially outward therefrom to enabling axle disassembly for cleaning purposes: and
connection means defining a projection on each one of the first and second axle members for enabling each one of the end portions to be connected to a corresponding end portion of a similar tubular component by interconnecting the projections of the corresponding axle members so that a facet on each one of the annular flanges bears against a facet on the similar tubular component to inhibit rotation, and for enabling a stretchable strip extending longitudinally along the tubular component to be anchored to each of the first and second axle members.

15. A device as recited in claim 14, further comprising:
stick-receiving means defining an opening in each projection for receiving an elongated member to enable connection by placement of an elongated member through the openings.

16. A method of hairdressing, comprising:
using a plurality of devices: each device comprising a tubular component having a first end portion, a second end portion, and a mid-portion therebetween about which to wind a lock of hair in the processof hairdressing; a first annular flange attached to the first end portion and a second annular flange attached to the second end portion, each annular flange having a periphery with a plurality of facets; and connector means for enabling connection of each one of the end portions to a correspodning end portion of a similar device so that a facet on each one of the annular flanges bear against a facet on the similar device to inhibit rotation;
arranging a first series of the devices in a first row extendng in a first common plane with selected locks of hair wound around the mid-portions and with the end portions interconnected with facets of adjacent devices engaging one another to inhibit axial rotation;
arranging a second series of the devices similarly in a second row extending in a second common plane with other selected locks of hair wound around the mid-portions with facets of adjacent devices engaging one another to inhibit axial rotation;
engaging corresponding facets of a device in the first row with a device in the second row: and
interconnecting the end portins of said device in the first row with the end portion of said device in the second row at a desired angle between the rows.

* * * * *